US006148566A

United States Patent [19]

Giszpenc et al.

[11] Patent Number: 6,148,566

[45] Date of Patent: Nov. 21, 2000

[54] CORNER PANEL ASSEMBLY

[75] Inventors: Nicolas Giszpenc, Sherman Oaks; Todd Howell, Studio City, both of Calif.

[73] Assignee: Ten-Two-Six, Inc., Studio City, Calif.

[21] Appl. No.: 09/280,146

[22] Filed: Mar. 26, 1999

Related U.S. Application Data

[60] Provisional application No. 60/079,411, Mar. 26, 1998.

[51] Int. Cl.[7] ..... E04F 19/00

[52] U.S. Cl. ..... 52/27; 52/288.1; 52/718.03

[58] Field of Search ..... 52/27, 287.1, 288.1, 52/718.01, 718.03

[56] References Cited

U.S. PATENT DOCUMENTS

| | | | |
|---|---|---|---|
| 396,126 | 1/1889 | White | 52/287.1 |
| 450,102 | 4/1891 | Howell | 52/287.1 |
| 1,919,300 | 7/1933 | Lewis | 52/288.1 |
| 2,878,053 | 3/1959 | Yuncker | 52/288.1 X |
| 2,991,557 | 7/1961 | Bellocchio . | |
| 4,150,517 | 4/1979 | Warner, Sr. | 52/288.1 |
| 4,224,467 | 9/1980 | Lewis . | |
| 4,536,995 | 8/1985 | Frederick . | |
| 4,972,633 | 11/1990 | Wright . | |

*Primary Examiner*—Beth A. Stephan
*Assistant Examiner*—Brian E. Glessner
*Attorney, Agent, or Firm*—Alan R. Davis; Louis Dachs

[57] ABSTRACT

The invention is a corner panel assembly for mounting at the intersection of at least two surfaces. In detail, the panel assembly includes a panel for mounting in the corner, with the panel having a first principle surface facing the corner and a second principle surface facing away from the corner. An attachment fitting is mounted to one of the surfaces in proximity to the corner. A cord at least partially incorporating and elastic element has a first end attachable to the attachment fitting and a fastening assembly for attaching the second end of the cord to the panel in proximity to the center thereof.

7 Claims, 3 Drawing Sheets

CORNER PANEL ASSEMBLY

This Application claims benefit to Provisional Application 60/079,411 Filed Mar. 26, 1998.

BACKGROUND OF THE INVENTION

1. Field of the Invention

The invention relates to the field of corner panel assemblies for mounting in a corner of a room and, in particular, to a corner panel assembly for mounting clocks, speakers, displays and the like, which is easy to install and position.

2. Description of Related Art

It has long been known that mounting speakers in the corner of a room where the sides walls and ceiling meet provides sound focusing. In addition to speakers, clocks or other display panels so placed are easy to see no matter where one is positioned in the room. Of course, it is the natural position for locating surveillance cameras where they can be shielded.

For example, U.S. Pat. No. 4,224,467 "Corner Mounting Sound Reproduction Speaker Apparatus" by A. G. Lewis, et al. suggests that mounting speakers in the upper and lower corners of a wall can focus the sound to a particular point in the room. Mounting is accomplished by attaching a triangular shaped top panel to the front panel that is adapted to fit flush with the ceiling. The top panel incorporates a slot in the rear corner that engages a bolt extending from the ceiling, positioned in the apex of the corner. In addition saw tooth brackets mounted to the sides of the top panel engage additional fasteners in the walls near the ceiling. While certainly securing the apparatus in place, the use of multiple attachment points requires precise placement of the fasteners in the wall. U.S. Pat. No. 4,536,995 "Corner Panel Assembly" by R. A. Frederick attaches the panel by individual fasteners extending through the three vertexes thereof. If the panel must be removed to repair or replace a speaker or a TV camera or the like, three fasteners must be removed, a time consuming operation. In both of the above examples, if the panel is subsequently replaced, three fastener holes must be repaired.

U.S. Pat. No. 4,972,633 "Corner Mounted Shield" by D. D. Wright discloses a panel incorporating a transparent window that is mounted to the wall by means of brackets about the periphery thereof by gluing, welding or conventional fasteners. Access to the interior of the installed panel by removing the window, which is held in place by tamper proof fasteners. Here again, if the panel is subsequently removed, the walls will require extensive repairs. U.S. Pat. No. 2,991,577 "Corner Picture Frame Assembly" by R. E. Bellocchio uses a wire attached by one end to one corner of the panel that passes through a eyelet attached at the apex of the three walls and is joined by its second end to a spring attached to a second corner of the panel. While having the advantage of only one attach point in the walls of the room, it is difficult to mount. To install, the wire must be adjusted in length prior to installation of the panel so that there is sufficient tension on the spring to absorb the weight of the panel and any item installed thereon. This may require several adjustments before proper spring tension is achieved. The comments above generally apply also to corner panels for mounting at the intersection of just two walls, for example a room wall and ceiling. Thus none of the prior art methods of attaching provide a simple system for mounting.

Thus, it is a primary object of the invention to provide a corner panel assembly that is easy to attach to the wall.

It is another primary object of the invention to provide a corner panel assembly that can be secured from the front of the panel.

It is a further object of the invention to provide a corner panel assembly that mounts to the wall at only a single attach point.

It is a still further object of the invention to provide a corner panel assembly wherein the tension load at which it is mounted to the wall can easily be adjusted.

SUMMARY OF THE INVENTION

The invention is a corner panel assembly for mounting at the intersection of at least two walls of a room. The corner typically can include two side walls and a ceiling or a side wall and ceiling. While it is contemplated the corners are in a room; the use of the corner panel assembly is not limited to use in rooms. In detail, the invention includes a panel for mounting in a corner, the panel having a first principle surface for facing the corner and a second principle surface for facing away from the corner. An attachment fitting, such screw type fastener having a ring type head, is mounted to one of the walls in proximity to the corner or it can be mounted directly in the corner. A cord, having first and second ends at least partially consisting of an elastic element, has a first end attached to the attachment fitting. In one embodiment, the second end of the cord is attached directly to the panel at the center or in proximity to center of the panel.

In a second embodiment, the second end of the cord is attached to the panel by means of an adjustable fastening device. This device includes a plurality of beads mounted on at least a portion of the cord including the second end thereof with the cord having a first specific diameter and the beads having a larger second specific diameter. The panel incorporates a hole with a third specific diameter, with the third specific diameter greater than the second specific diameter of the beads. The panel also includes a slot in communication with the hole with the slot having a width greater than the first specific diameter of the cord, but less than the second specific diameter of the beads. The panel further includes a dimpled surface in the area of the slot, causing the slot to be concave on the second principle surface. Thus the cord can be pulled through the hole in the panel and stretched until the desired tension load is achieved. Thereafter, the cord can be moved into the slot until the closest adjacent bead is aligned with the dimple. The cord is then released and the bead is captured by the dimple, locking the cord in place.

The panel assembly can include a panel that incorporates at least one cup shaped member, with one of the cups located in proximity to the center of the panel and having an opening on the first principle surface with the at least one cup extending out of the first principle surface. In this embodiment the cord attaches to the bottom surface of center mounted cup. In addition, the panel can be four sided, either square or rectangular shaped for mounting in a corner between a side wall and a ceiling. Here also it can include recesses for clocks and the like, or may incorporate top and bottom grooves for mounting pictures or signs.

The novel features which are believed to be characteristic of the invention, both as to its organization and method of operation, together with further objects and advantages thereof, will be better understood from the following description in connection with the accompanying drawings in which the presently preferred embodiments of the invention are illustrated by way of example. It is to be expressly understood, however, that the drawings are for purposes of illustration and description only and are not intended as a definition of the limits of the invention.

DESCRIPTION OF THE PREFERRED EMBODIMENT

Figure 1:
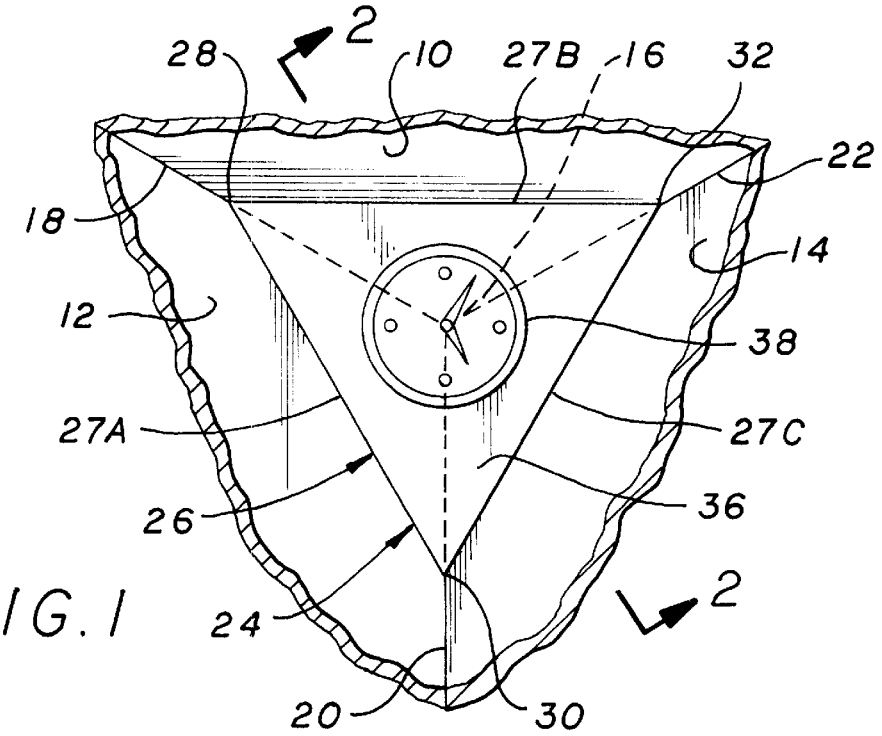
FIG. 1 is a perspective view of the subject panel mounted in the corner formed by the intersection of side walls and a ceiling wherein the panel is adapted to mount a clock.
Figure 2:
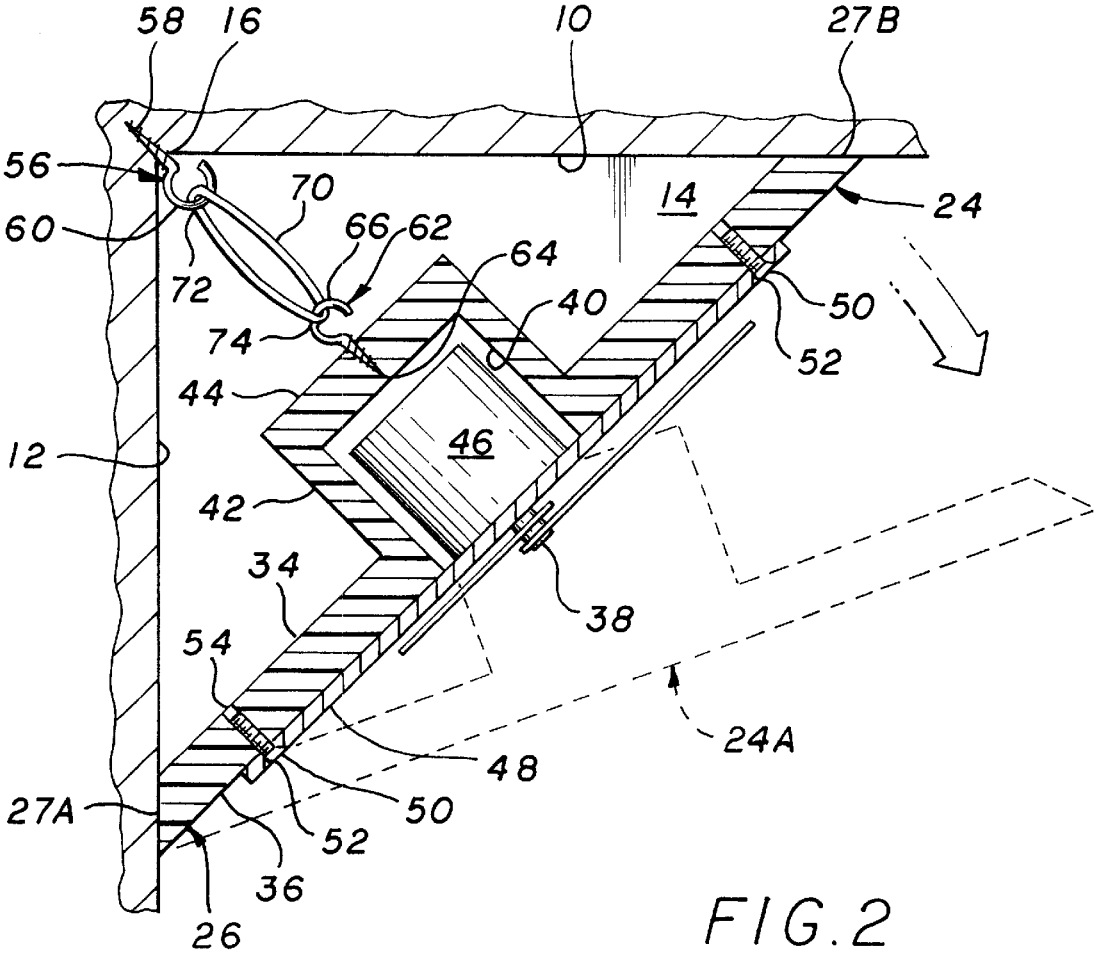
FIG. 2 is a cross-sectional view of FIG. 1 taken along the line 2—2 illustrating the attachment of the panel assembly with a clock mounted in a recess in the panel with the clock is mounted in a recess in the panel and the panel is mounted by means of a elastic cord attached between an attachment fitting mounted in the corner and the opposite end attached to the bottom of the recess.

Referring to FIGS. 1 and 2, the ceiling 10 and side walls 12 and 14 are shown meeting at a corner 16. The intersection of the side wall 12 with the ceiling 10 is indicated by numeral 18, the side wall 12 with the side wall 14 indicated by numeral 20 and the intersection of side wall 14 with the ceiling indicated by numeral 22. The subject corner assembly 24 includes a triangular shaped panel 26 having sides 27A, 27B and 27C, a first apex 28 at the intersection 18, a second at the intersection 30, a third apex 32 at the intersection 22, and first and second principle sides or surfaces 34 and 36, respectively. For purposes of illustration, the panel 26 includes a clock 38 mounted in a cup shaped receptacle 40 having a side wall 42 and back wall 44. The clock 38 includes a body portion 46 mounted within the receptacle 40 and a mounting flange 48 mounted to the second principle surface 36 by threaded fasteners 50 that extend through holes 52 in the flange and engage threaded holes 54 in the panel 26.

An attachment fitting 56 is mounted in the corner 16 and includes a threaded screw end 58 threaded into the corner and a hook 60 at its opposite end. Note that the fitting 56 could be attached to the ceiling 10 or side walls 12 or 14, as long as it is very close to the corner 16. A second attachment fitting 62 is mounted in the center 64 of the back wall 44 also having a threaded screw end 64 and at its opposite end a hook 66. A closed loop elastic cord 70, or at least partially elastic, is attached at one end 72 to the hook 60 and at its opposite end 74 to the hook 66. The cord 70 has a free length that is selected such that when attached to between the attachment fittings 56 and 62 and with the panel installed as illustrated with its edges 27A and 27C in contact with walls 12 and 14 and edge 27B with ceiling 10, the cord is under a tension load greater than the weight of the panel 26 with clock 64. However, the cord 70 need not be of a closed loop construction. For example, it could be a single cord with looped ends. In addition, it need not be made of completely elastic material. However, it must have sufficient elasticity so as to allow installation.

Installation is accomplished by: 1) attaching end 74 of the cord 70 to the hook 66, 2) placing the panel assembly 24 in the position indicated in dotted lines and numeral 24A with one edge, for example edges 27A against wall 12, 3) reaching around one of the opposite edges 27B or 27C with one hand and attaching end 72 of the cord to the hook 60, 4) placing the panel assembly 24 back against ceiling 10 and wall 14.

Figure 3:
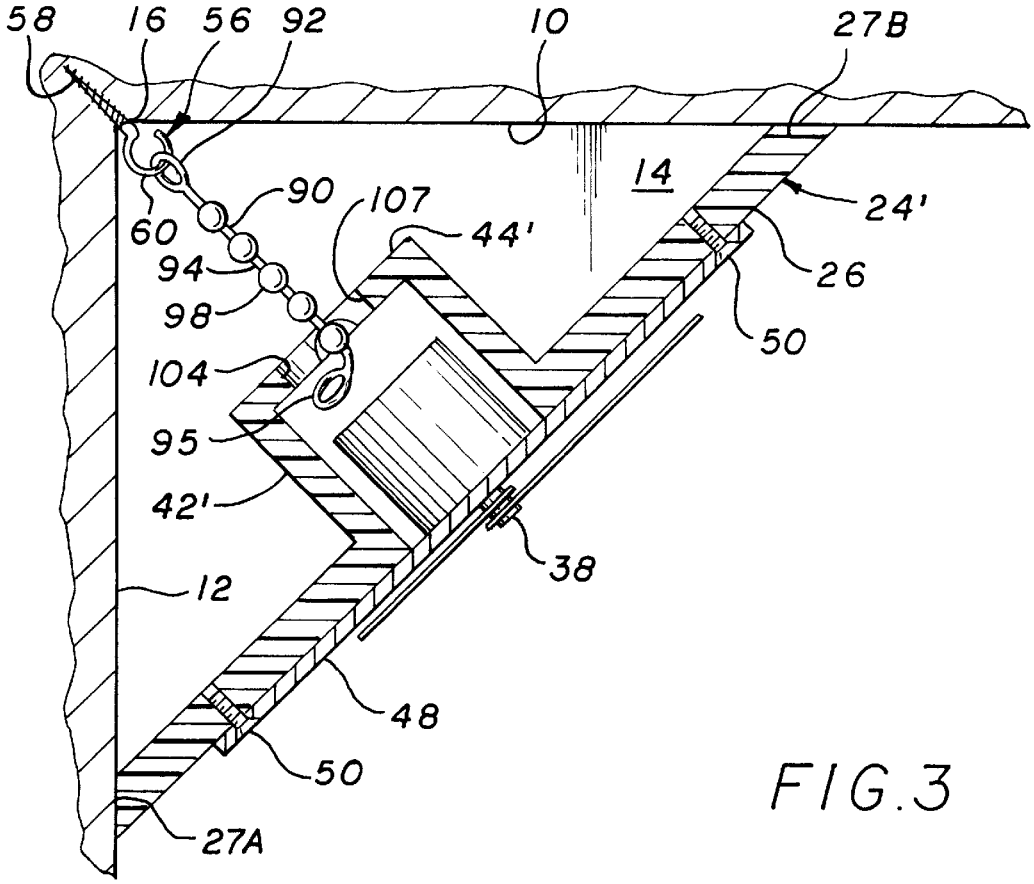
FIG. 3 is a view similar to FIG. 2 by a system wherein the tension load on the elastic cord can be varied.
Figure 4:
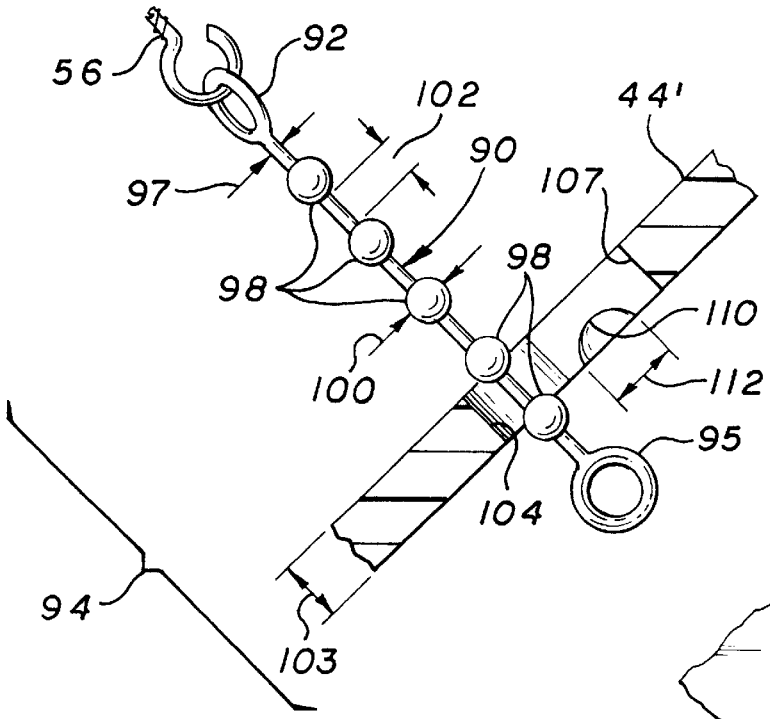
FIG. 4 is an enlarged view of a portion of the panel shown in FIG. 3 illustrating the system to vary the tension load on the cord.
Figure 5:
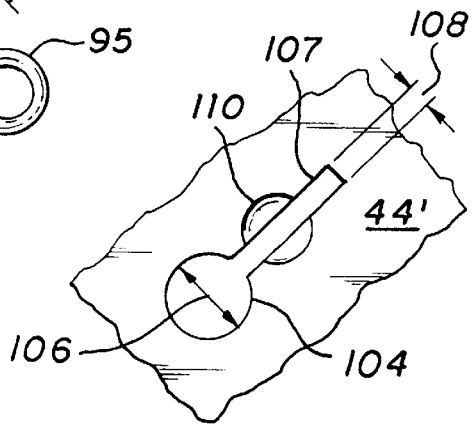
FIG. 5 is a front view of the portion of the panel shown in FIG. 4.

Illustrated in FIGS. 3–5 is a second embodiment of the invention wherein a panel assembly 24' similar to the panel assembly 24 except for the method of attachment. Thus all similar elements have the same indicating numeral. In this embodiment the cord, indicated by numeral 90, is made, at least partially, from elastic material, and has a looped end 92 attached to the hook 60. The cord 90, in proximity to the second looped end 92 has a diameter indicated by numeral 97. The portion 94 of the cord 90 includes a series of beads 98 mounted thereon in a spaced relationship, having diameters indicated by numeral 100, with the distance between beads indicated by numeral 102. The bottom wall 44' of the cup 42 has a thickness indicated by numeral 103 that is slightly less than the distance 100 between beads 98. The wall 44' further includes a hole 104 generally in the center of the panel 24' having a diameter 106 somewhat larger than the diameter 100 of the beads 98. Adjacent the hole 104 is a slot 107 having a width 108 slightly larger than the diameter 97 of the cord 90 but less than the diameter 100 of the beads 98. A dimple 110 having a diameter 112 slightly larger than the diameter 100 of the beads 98 is formed in the bottom wall 44'.

Installation of the panel assembly 24' is accomplished by first unscrewing the fasteners 50 and removing the clock 38. The end 92 of the cord 90 is attached to the hook 60 of the fastener assembly 56. The end 95 of the cord 90 is inserted through the hole 104 in the bottom wall 44' of the cup 42 as the panel 26 is brought into place. The cord 90 is then stretched until it is tight as required. The cord 90 is then moved sideways until it is engaged with the slot 107. The cord 90 is then released such that the bead 98 nearest the slot 107 retracts into the dimple 110, securing the cord to the bottom wall 44' and, of course connecting the panel 26 to the corner 16. Note that the width 108 of the slot 107 being smaller than the diameter 100 of the bead 98, the bead is prevented from "falling" through the slot. The dimple 110 prevents the bead 98 from moving sideways back out the hole 104. Thereafter, the clock 38 can be reinstalled.

Figure 7:
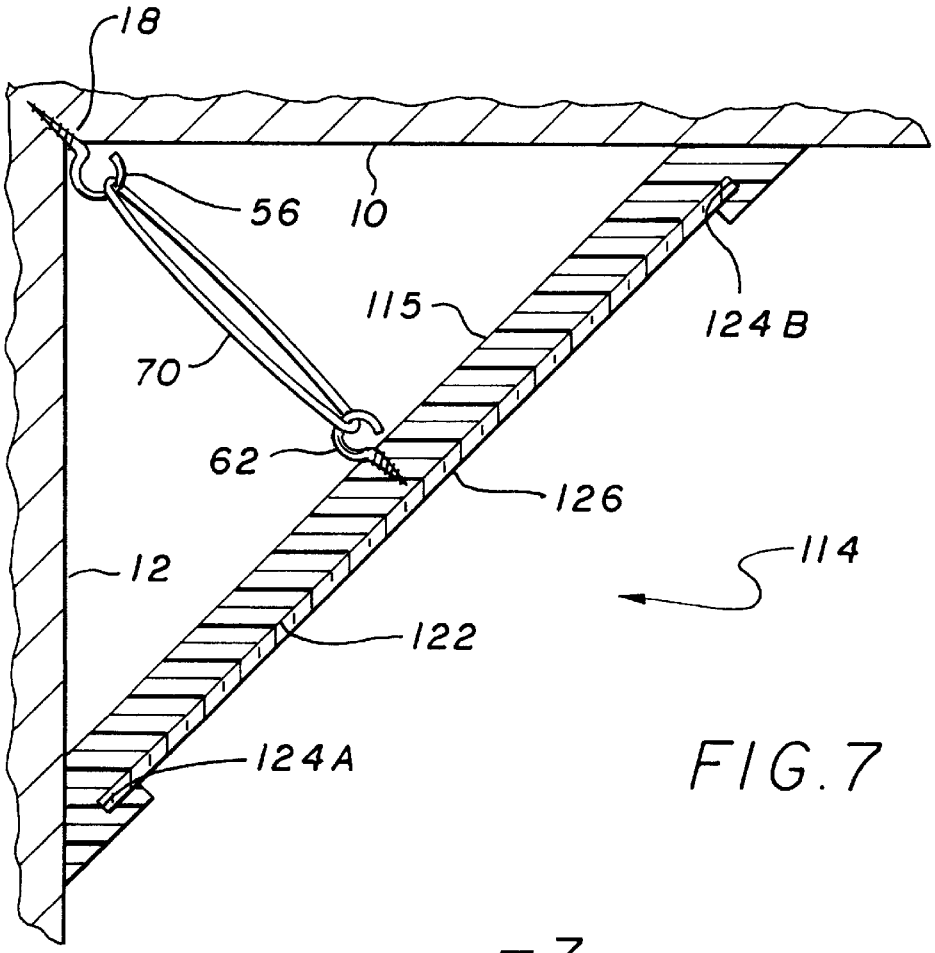
FIG. 7 is a cross-sectional view of FIG. 6 taken along the line 6—6.
Figure 6:
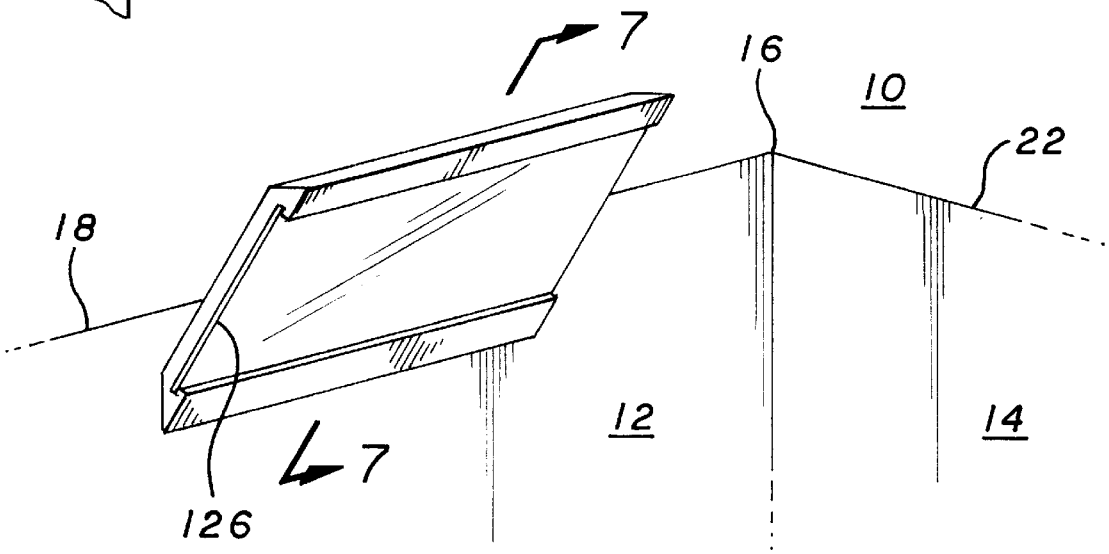
FIG. 6 perspective view of a panel assembly for mounting in a corner formed by a side wall and ceiling and wherein the panel is adapted to mount a picture.

Referring now to FIGS. 6 and 7, a corner panel assembly 114 is illustrated that includes a rectangular panel 115 attached to the corner 18 between wall 12 and ceiling 10. Note that a fastener assembly 56 is installed in the intersection 18 and a cord 70 is used to attach the fastener assembly to a fastener assembly 62 mounted in the panel assembly 114 at its center in the manner as illustrated in FIGS. 1 and 2. Here the rectangular panel includes a recess 122 having slots 124A and 124B at each end for receiving a sign 126. Note that the attachment system as illustrated in FIGS. 3–5 can also be used.

Thus it can be seen that the corner panel is easy to attach to the wall and can be easily secured from the front of the panel by means of only a single attach point. Furthermore, in one embodiment the tension load on the corner panel assembly can easily adjusted. Furthermore, while several preferred methods of single point attachment have been illustrated, it should be understood that main thrust of the invention is the single point attachment at both the wall and the center of the panel.

While the invention has been described with reference to particular embodiments, it should be understood that the embodiments are merely illustrative, as there are numerous variations and modifications, which may be made by those skilled in the art. Thus, the invention is to be construed as being limited only by the spirit and scope of the appended claims.

INDUSTRIAL APPLICABILITY

The invention has applicability to picture frame, audio speaker and sign manufacturing industries; any industry that manufactures items to mounted or displayed on walls.

What is claimed is:

1. A corner panel assembly for mounting over the corner formed by the intersection of at least two walls and for mounting thereto, said assembly comprising:

a panel for mounting in the corner, said panel having a first principle surface for facing the corner and a second principle surface for facing away from the corner, said panel being adapted to contact the at least two walls;

an attachment fitting for mounting to one of the walls in proximity to the corner;

a cord having a first specific diameter at least partially incorporating an elastic element having first and second ends, said first end attachable to said attachment fitting; and means to attach said second end of said cord to said panel in proximity to the center thereof; said means comprises:

a plurality of beads mounted on at least a portion of said cord including said second end thereof, said beads having a second specific diameter;

said panel having a hole with a third specific diameter, said third specific diameter greater than said second specific diameter;

said panel having a slot in communication with said hole in said panel, said slot having a width greater than said first specific diameter, but less than said second specific diameter; and said panel having a dimpled surface in the area of said slot, causing said slot to be concave on said second principle surface.

2. The panel assembly as set forth in claim 1 wherein said means to attach said cord in said panel comprises a hook attached to said first principle surface of said panel in proximity to said center thereof for attaching said second end of said cord thereto.

3. The panel assembly as set forth in claim 1, or 2 comprising:

said panel having at least one cup shaped member having an opening on said first principle surface, said at least one cup shaped member extending out of said first principle surface, one said cup shaped member mounted in the center of said panel;

said means to attach said cord in said panel attaches said cord to the bottom surface of said one cup mounted in the center of said panel.

4. The panel assembly as set forth in claim 1, or 2, wherein there are three walls with one of the walls being a ceiling said panel assembly comprising said panel being triangular shaped.

5. The panel assembly as set forth in claim 1, or 2, wherein there are two walls, said panel assembly comprising said panel being four sided.

6. A corner panel assembly for mounting over a corner space defined in part by a pair of vertical side walls and a ceiling intersecting at a point and for mounting to said side walls and ceiling, the panel assembly comprising:

a triangular shaped panel for mounting in the corner, said panel when mounted having a first vertex in contact at the junction of said side walls, a second vertex in contact at the junction of one of said side walls and said ceiling and a third vertex in contact with the other side wall and ceiling forming a three sided pyramid shaped space between the panel and said side walls and ceiling, said panel having a first principle surface for facing the corner and a second principle surface for facing away from the corner;

an attachment fitting for mounting to one of the walls in proximity to the intersecting point;

a cord having a specific diameter and at least partially incorporating an elastic element having first and second ends, said first end attachable to said attachment fitting; and means to attach said second end of said cord to said panel in proximity to the center thereof, said means comprising:

said cord having a first specific diameter;

said means to attach said second end of said cord to said panel comprises:

a plurality of beads mounted on at least a portion of said cord including said second end thereof, said beads having a second specific diameter;

said panel having a hole with a third specific diameter, said third specific diameter greater than said second specific diameter;

said panel having a slot in communication with said hole in said panel, said slot having a width greater than said first specific diameter, but less than said second specific diameter; and said panel having a dimpled surface in the area of said slot, causing said slot to be concave on said second principle surface.

7. The panel assembly as set forth in claim 6 comprising:

said panel having at least one cup shaped member having an opening on said first principle surface, said at least one cup shaped member extending out of said first principle surface, one said cup shaped member mounted in the center of said panel;

said means to attach said cord in said panel attaches said cord to the bottom surface of said one cup mounted in the center of said panel.

* * * * *